US005595471A

United States Patent [19]

Ajilore

[11] Patent Number: 5,595,471

[45] Date of Patent: Jan. 21, 1997

[54] LINKAGE ARRANGEMENT

[75] Inventor: Akin O. Ajilore, Macomb, Mich.

[73] Assignee: Caterpillar Inc., Peoria, Ill.

[21] Appl. No.: 345,962

[22] Filed: Nov. 28, 1994

[51] Int. Cl.[6] ..... E02F 3/36

[52] U.S. Cl. ..... 414/685; 414/722

[58] Field of Search ..... 414/685, 722, 414/723, 680, 686, 697; 37/468

[56] References Cited

U.S. PATENT DOCUMENTS

| | | | |
|---|---|---|---|
| 4,364,700 | 12/1982 | Arabshian et al. | 414/697 X |
| 4,626,163 | 12/1986 | Link et al. | 414/685 |
| 4,768,917 | 9/1988 | Garman | 414/697 |
| 4,798,512 | 1/1989 | Intveld | 414/697 X |
| 4,844,685 | 7/1989 | Sagaser | 414/700 |

*Primary Examiner*—Donald W. Underwood

*Attorney, Agent, or Firm*—William C. Perry

[57] ABSTRACT

In the operation of heavy equipment such as wheel loaders the amount of force subjected to the linkage arrangement that connects the work implement to the loader is normally quite large. In order to accommodate such loading, it has been common practice to increase the size of the various components within the linkage arrangements. The increase in size has greatly increased the weight of the linkage arrangement thus reducing the performance capabilities of the machine. The present invention utilizes a linkage arrangement (10) wherein the specific points of greatest loading have been grouped together son the various components of the linkage. In doing so, only these areas will require areas of significant increases in mass to accommodate the more severe loading. Also the particular positioning between the various components is specifically designed to simplify their construction. These combined factors substantially reduce the overall weight of the linkage arrangement.

16 Claims, 2 Drawing Sheets

LINKAGE ARRANGEMENT

TECHNICAL FIELD

This file relates to a linkage arrangement that mounts a work implement to a machine and more particularly to a linkage arrangement that utilizes a boom-type lift arm to connect the work implement to the machine.

BACKGROUND ART

In earthworking machines such as wheel loaders, a work implement such as a bucket is mounted to the front end of a machine by a linkage arrangement that permits the manipulation of the bucket to excavate and load material in a variety of ways. The bucket is mounted to the machine by one or more lift arms and is lifted in a vertical plane by a pair of hydraulic cylinders that extend between the lift arm and the machine. A portion of the linkage arrangement usually incorporates a combination of links that connect an upper portion of the bucket to another hydraulic cylinder that when actuated, will pivot the bucket with respect to the lift arm. With this type of linkage, material may be loaded into the bucket under motive force of the vehicle and elevated by the lift arms. The material may then be dumped into a nearby truck or it may be transported in the bucket to be deposited at a remote site.

During the operation of the wheel loader, the bucket and the linkage arrangement is subjected to varying degrees of force, some of rather severe magnitude. It is therefore critical that each component of the linkage arrangement is of sufficient size and is sufficiently configured to withstand the forces encountered during operation. It must be noted however, that while the size and configuration of the respective components of a linkage arrangement are critical, so is the weight of the components. It is therefore very desirable to provide a linkage arrangement that is not only strong enough to withstand severe loading but will not add unduly to the overall weight of the machine and thereby detract from the performance capabilities of the machine.

In some instances, linkage arrangements have been known to utilized a single lift arm instead of a pair of lift arms that normally extend between the bucket and the machine. One such design is disclosed in U.S. Pat. 4,768,917 issued to Anthony L. Garman on Sep. 6, 1988. In this design the tilting arrangement utilizes a tilt lever that is an elongate member having three distinct areas of connection that will be subjected to the majority of the loads during the operation of the linkage. These areas of loading occur at the connection points between the tilt lever and the tilt cylinder, the tilt links and the bucket. Because these areas are distinct and are spread out over the length of the tilt lever, the mass of the tilt lever must be increased in each of these locations to accommodate the loading that will be applied to the linkage at each of these areas. While this is not necessarily a significant disadvantage on wheel loaders that are relatively small, the increase in mass in each of the three areas of connection will result in a dramatic increase in weight when utilized on larger vehicles. The increase in weight not only detracts from the performance capabilities of the machine, it also dramatically increases the cost of the components. Another disadvantage that is apparent in the design is the necessity to utilize two tilt inks on opposite sides of the tilt lever. This not only increases the overall weight of the linkage but also increases the number of components.

The present invention is directed to overcoming one or more of the problems as set forth above.

DISCLOSURE OF THE INVENTION

In one aspect of the present invention a linkage arrangement for connecting a work implement to a machine is provided. The linkage arrangement includes a first link that has a first end portion connected to the work implement and a second end portion connected to the machine. The first link is moveable in a generally vertical plane with respect to the machine. A second link is provided that has a first, bifurcated end portion defining a pair of plates that are spaced from one another. A second end portion of the second link is pivotally connected to the work implement. A third link is provided that has a first, bifurcated end portion positioned to straddle the first link and is pivotally connected thereto. A second end portion of the third link is positioned between the plates defined by the first end portion of the second link and is pivotally connected to the plates. A means for pivoting the work implement with respect to the first link is provided that has a first end portion connected to the machine and a second end portion positioned between the plates defined by the first end portion of the second link and is pivotally mounted to the plates.

In another aspect of the present invention a linkage arrangement is provided for connecting a work implement to a machine. The linkage arrangement includes a boom-type lift arm that has a first, bifurcated end portion pivotally mounted to the work implement. A second end portion of the lift arm is pivotally mounted to the machine at a point substantially along a centerline of the machine. The lift arm is moveable with respect to the vehicle along a generally vertical plane. A tilt lever is provided that has a first, bifurcated end portion defining a pair of spaced-apart plates and a second end portion that is pivotally mounted to the work implement at a point positioned substantially on a centerline defined by the work implement. A tilt link is provided that has a first, bifurcated end portion defining a pair of arms that are positioned on opposite sides of the lift arm and are pivotally connected to the lift arm. A second end portion of the tilt link is positioned between the plates defined by the first end portion of the tilt lever and is pivotally mounted thereto. A tilt cylinder is provided that has a first end portion that is pivotally mounted to the machine and a second end portion that is positioned between and pivotally mounted to the plates defined by the first end portion of the tilt lever. The tilt cylinder is actuatable to move the work implement with respect to the lift arm.

In yet another aspect of the present invention, a tilt linkage arrangement is provided for a work implement that is mounted to a machine by a centrally disposed lift arm for movement in a generally vertical plane. The linkage arrangement includes a tilt lever that has a first, bifurcated end portion that defines a pair of spaced apart plates and a second end portion that is pivotally connected to the work implement. A tilt link is provided that has a first, bifurcated end portion positioned to straddle the lift arm and is pivotally connected thereto. A second end portion of the tilt link is positioned between and pivotally connected to the spaced apart plates defined by the tilt lever. A tilt cylinder is provided that has a first end portion connected to the machine and a second end portion that is positioned between and pivotally connected to the spaced apart plates defined by the tilt lever. The tilt cylinder is moveable to cause pivoting of the work implement with respect to the lift arm.

With a linkage arrangement as set forth above, it can be seen that the components are configured to provide the appropriate mass to each of the load bearing areas of the respective components. As a result, the linkage arrangement provides a maximum amount of load carrying capabilities at a very minimum of overall weight.

BEST MODE FOR CARRYING OUT THE INVENTION

Figure 1:
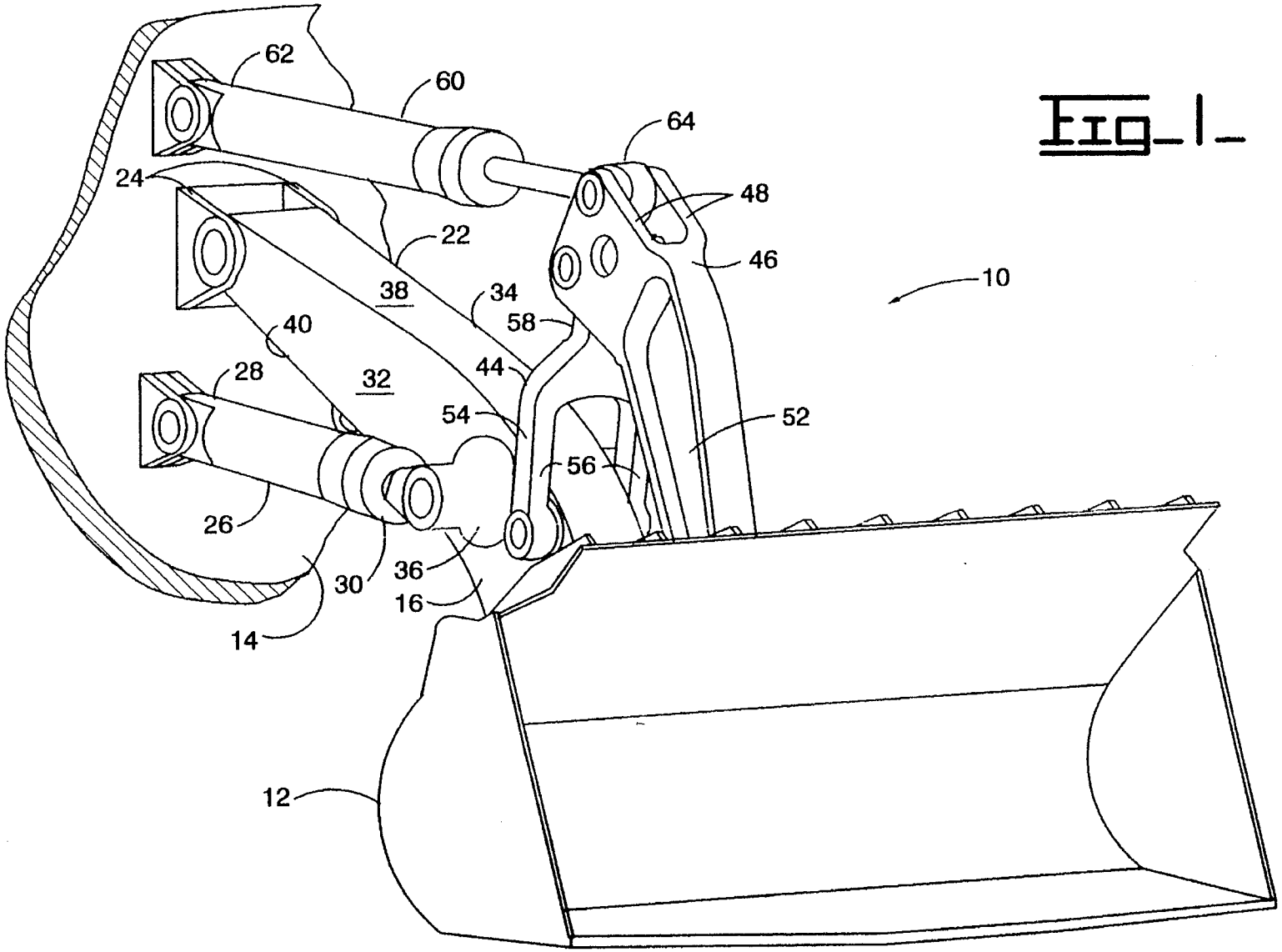
FIG. 1 is a diagrammatic perspective view of a linkage arrangement for the operation of a bucket that embodies the principles of the present invention.

Referring to the drawings, it can be seen that a loader linkage 10 is disclosed that connects a work implement 12 to a frame 14 of a machine (not shown). While the work implement could be one of any number of different tools, in the illustrated embodiment it is shown to be a bucket of the type that is commonly used in conjunction with a wheel loader.

The linkage arrangement 10 includes a first link 16 in the form of a lift arm that is directly positioned between the frame 14 and the bucket 12. The lift arm is the type that includes a single box boom construction that is substantially positioned on a vertical plane that is coincident with a centerline defined by the machine. While the illustrated embodiment envisions the boom made from a casting due to the curvature of the structure, it is also conceivable that the boom could be constructed from a fabrication. The lift arm has a first end portion 18 that is bifurcated to define a pair of spaced arm members 20 (FIG. 2) that are pivotally connected to the bucket 12. Each connection between the bucket and the respective arm members is substantially equidistantly spaced on opposite sides of the vertical plane. The second end portion 22 of the lift arm has a solid, or non-bifurcated configuration that has a reduced width as compared to the first end portion and is pivotally mounted between a pair of mounting plates 24 (FIG. 1) or other suitable structure defined by the frame 14 along the vertical plane.

The lift arm is moved generally along the vertical plane with respect to the machine by a pair of lift cylinders 26. Each lift cylinder has a first end portion 28 pivotally mounted to the frame 14 and a second end portion 30 that is connected to opposite side surfaces 32 and 34 of the lift arm. The second end portions 30 of each lift cylinder are pivotally connected to a projection 36 (one shown) that extends outwardly from the respective side portions 32 and 34 at a location that is substantially intermediate the first and second end portions 18 and 22 of the lift arm as well as upper and lower surfaces 38 and 40 thereof.

Figure 2:
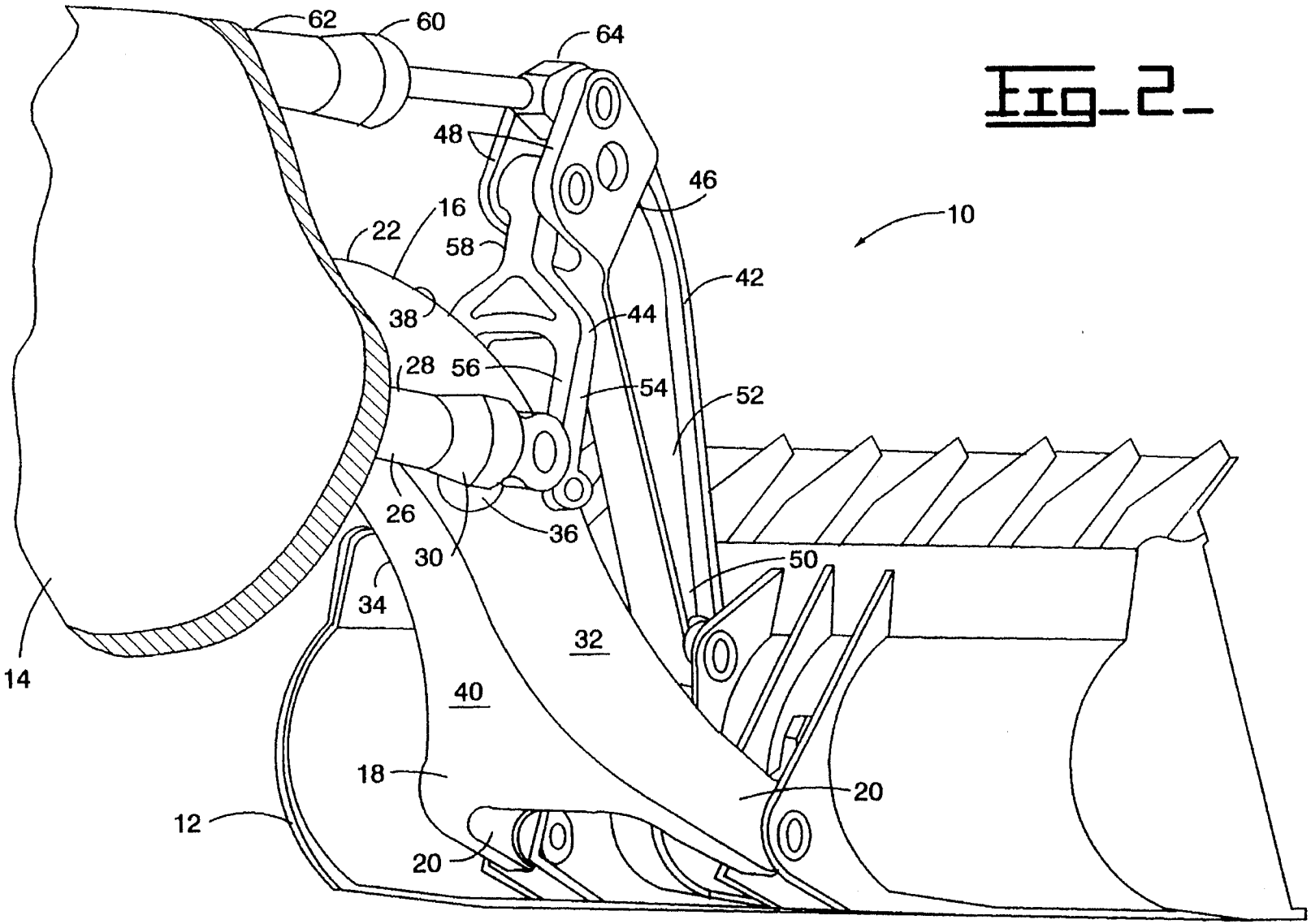
FIG. 2 is a diagrammatic perspective view of the linkage arrangement shown in FIG. 1 taken from a position behind the bucket.

The bucket 12 is pivoted with respect to its mounting with the lift arm by a second and third link 42 and 44 respectively, that are positioned between the bucket and the lift arm 16. The second link or tilt lever, has a first, bifurcated end portion 46 that defines a pair of spaced apart plates 48. As is best shown in FIG. 2, a second end portion 50 of the tilt lever 42 has a solid, or non-bifurcated configuration. The width of the second end portion is less than that of the first end portion and is pivotally mounted to the bucket. The connection between the second end portion 50 of the tilt lever and the bucket is elevationally above and centered between the connections between the spaced arm members 20 of the lift arm 16 and the bucket. A connecting portion 52 extends between the first and second end portions 46 and 50 respectively and has a configuration substantially similar to that of an I-beam.

The third link, or tilt link 44 is a wishbone-shaped link that has a first end portion 54 that defines a pair of leg portions 56. The tilt link is positioned to straddle the lift arm in a manner wherein each leg portion 56 is positioned on an opposite side thereof. Each leg portion 56 is pivotally mounted to the lift arm at a location that is positioned substantially along a plane that passes through the first and second end portions 28 and 30 of the lift cylinders 26. A second end portion 58 of the tilt link has a solid, or non-bifurcated configuration that has a substantially reduced width as compared to the first end portion so that it may be positioned between the plates 48 defined by the first end portion of the tilt lever 42 and is pivotally mounted to a lower region of the plates 48. This connection between the second end portion 58 of the tilt link and the first end portion of the tilt lever occurs substantially along the vertical plane passing through the centerline of the lift arm 16.

A means for pivoting the bucket with respect to the lift arm 16 is provided in the form of a tilt cylinder 60. The tilt cylinder 60 has a first end portion 62 that is connected to the frame 14 and a second end portion 64 that is positioned between plates 48 and is pivotally connected thereto. The connection point between the second end portion 64 of the tilt cylinder and the plates 48 occurs at a point that is along an upper region of the plates immediately above the connection with the second end portion 58 of the tilt link 44. When the tilt cylinder 60 is extended and retracted, the bucket 12, through its connection with the tilt lever is pivoted about its mounting with the arm members 20 of the lift arm 16.

Industrial Applicability

The operation of a machine such as a wheel loader normally includes the excavation of material from the ground or pile and the dumping of the material in a nearby truck or the movement thereof to a remote site. The bucket is loaded primarily under the motive force of the wheel loader as it is forced into the pile of material. The bucket is simultaneously lifted through extension of the lift cylinders 26 and rotated toward the machine, or racked back, by retraction of the tilt cylinder 60. In the event that the material is to be dumped into a nearby truck, the bucket will be raised to a height above that of the sidewalls of the truck. The machine will be driven toward the truck until the bucket extends over the bed whereupon the tilt cylinder 60 will be extended to rotate the bucket away from the machine to dump the material from the bucket.

It is well known, especially in larger machines, that the forces applied to the linkage arrangement can be extremely severe depending upon the force with which the machine is driven into the pile of material, the type of material being excavated and the amount or weight of material lifted and dumped from the bucket. In order to accommodate the most severe loads, it is imperative that the components of the linkage arrangement be of sufficient size mass especially in the areas of connection between the various components.

With the linkage arrangement 10 set forth above, it can be seen that the points of connection between the respective linkage components have been grouped together where possible and provided with sufficient mass in these areas to accommodate the necessary loading. The areas that do not have a concentrated area of loading may then be reduced in size yet are sufficient to withstand severe loading. In addition, the positioning of the individual links with respect to one another is also significant. Each link has a bifurcated end portion and a solid or non-bifurcated end portion. The links are positioned in a manner wherein the non-bifurcated end portion is connected to or closely adjacent to the bifurcated end portion of the adjacent links thereby optimizing the transfer of forces therebetween. In doing so, the linkage arrangement has sufficient load carrying capabilities while permitting substantial reductions in the overall weight of the linkage arrangement.

I claim:

1. A linkage arrangement for connecting a work implement to a machine, comprising:

a first link having a first end portion connectable to the work implement and a second end portion connectable to the machine and being moveable in a generally vertical plane with respect to the machine;

a second link having a first, bifurcated end portion defining a pair of plates that are spaced from one another and a second end portion that is pivotally connectable to the work implement;

a third link having a first, bifurcated end portion positioned to straddle the first link and being pivotally connected thereto and a second end portion positioned between the plates defined by the first end portion of the second link and being pivotally connected thereto at a lower portion thereof; and means for pivoting the work implement with respect to the first link, said pivoting means having a first end portion connectable to the machine and a second end portion positioned between the plates defined by the first end portion of the second link and being pivotally mounted to an upper portion thereof at a location that is immediately above the connecting point between the second and third links.

2. The linkage arrangement as set forth in claim 1 wherein the first link is a unitary boom assembly and the first end portion thereof is bifurcated to define a pair of spaced arm members that are pivotally correctable to the work implement, and the second end portion is non-bifurcated and is pivotally mountable to a frame portion of the machine, said boom and said work implement being substantially centerable along the vertical plane.

3. The linkage arrangement as set forth in claim 2 wherein the boom is movable along the vertical plane by a pair of lift cylinders each having a first end portion connectable to the frame of the machine and a second end portion connected to the boom on opposite sides thereof at a location that is substantially intermediate the first and second end portions of the boom.

4. The linkage arrangement as set forth in claim 1 wherein the second link is a tilt lever that further defines a connecting portion that extends between the first and second end portions and has a configuration that is generally in the shape of an I-beam.

5. The linkage arrangement as set forth in claim 3 wherein the third link is a tilt link generally having a wishbone configuration, said first end portion of the tilt link defining a pair of leg portions that are mounted to the boom at a location that is substantially aligned with a plane that passes through the first and second end portions of the lift cylinders.

6. A linkage arrangement for connecting a work implement to a machine, comprising:

a boom-type lift arm having a first, bifurcated end portion pivotally mountable to the work implement and a second end portion pivotally mountable to the machine at a point substantially along a centerline thereof, said lift arm being moveable with respect to the machine along a generally vertical plane;

a tilt lever having a first, bifurcated end portion defining a pair of spaced-apart plates and a second end portion pivotally mountable to the work implement at a point positioned substantially along the vertical plane;

a tilt link having a first, bifurcated end portion defining a pair of arms that are positioned on opposite sides of the lift arm and are pivotally connected thereto and a second end portion that is positioned between the plates defined by the first end portion of the tilt lever and being pivotally mounted thereto; and a tilt cylinder having a first end portion pivotally mountable to the machine and a second end portion positioned between the plates defined by the first end portion of the tilt lever and being pivotally mounted thereto at a location that is spaced from the connecting point between the tilt lever and tilt link, said tilt cylinder being actuatable to move the work implement with respect to the lift arm.

7. The linkage arrangement as set forth in claim 6 wherein a pair of lift cylinders are connected to the lift arm and are connectable to the machine to move the lift arm along the generally vertical plane.

8. The linkage arrangement as set forth in claim 7 wherein the lift cylinders each have a first end portion connectable to a frame defined by the machine and a second end portion connected to a projection that extends from opposite sides of the lift arm at a location that is substantially intermediate the end portions thereof and intermediate an upper and lower surface defined thereby.

9. The linkage arrangement as set forth in claim 7 wherein the tilt lever defines a connecting portion extending between the first and second end portions, said connecting portion being configured substantially in the shape of an I-beam and being positioned substantially along the vertical plane.

10. The linkage arrangement as set forth in claim 7 wherein the connection between the first end portion of the tilt lever and the second end portions of the tilt link and tilt cylinder are positioned substantially along the vertical plane.

11. The linkage arrangement as set forth in claim 10 wherein the connection between the tilt link and the tilt lever is positioned immediately subjacent the connection between tilt cylinder and tilt lever.

12. The linkage arrangement as set forth in claim 6 wherein the lift arm, the tilt lever and the tilt link are positioned relative to one another such that the bifurcated end portion of each of the components is connected to or connected in close proximity to a non-bifurcated portion of the adjacent component.

13. A tilt linkage arrangement for a bucket mounted to a wheel loader by a centrally disposed lift arm for movement in a generally vertical plane, comprising:

a tilt lever having a first, bifurcated end portion defining a pair of spaced apart plates and a second end portion pivotally connectable to the work implement;

a tilt link having a first, bifurcated end portion positioned to straddle the lift arm and being pivotally connected thereto, and a second end portion positioned between the spaced apart plates defined by the tilt lever and being pivotally connected thereto; and a tilt cylinder having a first end portion connectable to the machine and a second end portion positioned between and pivotally connected to the spaced apart plates defined by the tilt lever at a location spaced from the connection between the tilt link and the tilt lever, said tilt cylinder being moveable to cause pivoting of the work implement with respect to the lift arm.

14. The linkage arrangement as set forth in claim 13 wherein the lift arm defines a first bifurcated end portion that defines a pair of arms that are pivotally connectable to the bucket on opposite sides of the vertical plane and equally spaced therefrom, and a second, non-bifurcated end portion pivotally connectable to the wheel loader substantially along a mid portion thereof and being substantially centered about the vertical plane.

15. The linkage arrangement as set forth in claim 14 wherein the second end of the tilt lever is mountable to the bucket at a location that is elevationally above the connection between the arms of the lift arm and the work implement and is centered therebetween.

16. The linkage arrangement as set forth in claim 14 wherein the first end portion of the tilt lever and the respective connections with the tilt link and the tilt cylinder are substantially centered along the vertical plane.

* * * * *